US007213405B2

(12) United States Patent
Shapiro

(10) Patent No.: US 7,213,405 B2
(45) Date of Patent: May 8, 2007

(54) TWO-STAGE LINEAR COMPRESSOR

(75) Inventor: Doron Shapiro, St. Louis, MO (US)

(73) Assignee: Hussmann Corporation, Bridgeton, MO (US)

( * ) Notice: Subject to any disclaimer, the term of this patent is extended or adjusted under 35 U.S.C. 154(b) by 214 days.

(21) Appl. No.: 11/125,743

(22) Filed: May 10, 2005

(65) Prior Publication Data

US 2006/0254307 A1 Nov. 16, 2006

(51) Int. Cl.
*F25B 27/00* (2006.01)

(52) U.S. Cl. ..... 62/228.3; 62/231; 62/498

(58) Field of Classification Search ..... 62/228.3, 62/231, 228.5, 498, 503, 504, 509, 510, 513
See application file for complete search history.

(56) References Cited

U.S. PATENT DOCUMENTS 3,229,475 A 1/1966 Balk et al.

(Continued)

FOREIGN PATENT DOCUMENTS

JP J10197082 7/1998

(Continued)

OTHER PUBLICATIONS

Reuven Z. Unger, Linear Compressors for Clean and Specialty Gases, 1998 International Compressor Engineering Conference, Purdue University, Jul. 14-17, 1998.

*Primary Examiner*—Mohammad M. Ali
(74) *Attorney, Agent, or Firm*—Michael Best & Friedrich LLP

(57) ABSTRACT

A refrigeration system includes a dual-piston linear compressor including a first piston disposed in a first cylinder and a second piston opposed to the first piston and disposed in a second cylinder. The first piston divides the first cylinder into a first suction chamber and a first discharge chamber and the second piston divides the second cylinder into a second suction chamber and a second discharge chamber. The refrigeration system also includes a first gas flow path through the linear compressor, a second gas flow path through the linear compressor, and a controller operable to switch the linear compressor between an economizer cycle and a single stage cycle wherein in the economizer cycle flow of gas is along the first gas flow path and in the single stage cycle flow of gas is along the second gas flow path. At least one discharge control valve coupled to the controller and responsive to control signals from the controller is operable to direct gas from the first and second discharge chambers to the first gas flow path or the second gas flow path. At least one suction control valve coupled to the controller and responsive to control signals from the controller is operable to direct gas to the first and second suction chambers along the first gas flow path or the second gas flow path.

30 Claims, 4 Drawing Sheets

U.S. PATENT DOCUMENTS

| | | | | |
|---|---|---|---|---|
| 3,937,600 | A | 2/1976 | White | |
| 4,580,414 | A | 4/1986 | Engelhard | |
| 4,750,871 | A | 6/1988 | Curwen | |
| 5,095,712 | A * | 3/1992 | Narreau | 62/113 |
| 5,600,961 | A | 2/1997 | Whipple, III | |
| 5,775,117 | A * | 7/1998 | Shaw | 62/196.3 |
| 5,779,455 | A | 7/1998 | Steiger | |
| 5,980,211 | A * | 11/1999 | Tojo et al. | 417/45 |
| 6,082,132 | A | 7/2000 | Numoto et al. | |
| 6,092,999 | A * | 7/2000 | Lilie et al. | 417/415 |
| 6,105,378 | A * | 8/2000 | Shaw | 62/196.3 |
| 6,231,310 | B1 | 5/2001 | Tojo et al. | |
| 6,276,148 | B1 * | 8/2001 | Shaw | 62/117 |
| 6,286,326 | B1 | 9/2001 | Kopko | |
| 6,425,255 | B1 | 7/2002 | Hoffman | |
| 6,437,524 | B1 | 8/2002 | Dimanstein | |
| 6,527,519 | B2 | 3/2003 | Hwang et al. | |
| 6,619,052 | B1 | 9/2003 | Nash, Jr. | |
| 6,623,246 | B2 * | 9/2003 | Hwang et al. | 417/44.1 |
| 6,623,255 | B2 | 9/2003 | Joong et al. | |
| 6,641,377 | B2 | 11/2003 | Toyama et al. | |
| 6,663,351 | B2 | 12/2003 | Joo | |
| 7,032,400 | B2 | 4/2006 | Roche et al. | |
| 2003/0213256 | A1 | 11/2003 | Ueda et al. | |
| 2005/0098162 | A1 * | 5/2005 | Bryant | 123/559.1 |
| 2006/0171825 | A1 | 8/2006 | Choi et al. | |

FOREIGN PATENT DOCUMENTS

| | | | |
|---|---|---|---|
| JP | 11-337198 | A * | 12/1999 |

* cited by examiner

TWO-STAGE LINEAR COMPRESSOR

BACKGROUND

The present invention relates to a refrigeration system including a dual-opposed piston linear compressor, and more particularly to an application of an economizer cycle to the linear compressor.

In refrigeration systems, such as those used in cooling display cases of refrigeration merchandisers, it is necessary to maintain a constant temperature in the display cases to ensure the quality and condition of the stored commodity. Many factors cause varying cooling loads on evaporators cooling display cases. Therefore, selective operation of the compressor of the refrigeration system at different cooling capacities corresponds to the cooling demand of the evaporators. Further, as ambient outdoor temperature decreases, compressor loading typically decreases due to lower system lift. In refrigeration systems utilizing existing scroll and screw compressors, an economizer cycle is used to increase the refrigeration capacity and improve efficiency of the refrigeration system. In the economizer cycle of existing scroll and screw compressors, gas pockets in the compressor create a second "piston" as the mechanical elements of the compressor proceed through the compression process.

Further, scroll compressors use oil for operation, which results in inefficient performance due to oil film on evaporator and condenser surfaces, requires the use of expensive oil management components, and increases the installation cost of the refrigeration system. Some refrigeration systems utilize a linear compressor, which provides variable capacity control of the refrigeration system.

SUMMARY

In one embodiment, the invention provides a refrigeration system including a dual-piston linear compressor having a first piston disposed in a first cylinder and a second piston opposed to the first piston and disposed in a second cylinder. The first piston divides the first cylinder into a first suction chamber and a first discharge chamber, and the second piston divides the second cylinder into a second suction chamber and a second discharge chamber. The refrigeration system also includes a first gas flow path through the linear compressor, a second gas flow path through the linear compressor, and a controller operable to switch the linear compressor between an economizer cycle with two stage compression and a single stage cycle. In the economizer cycle, flow of gas is along the first gas flow path, and in the single stage cycle flow of gas is along the second gas flow path. At least one discharge control valve is coupled to the controller and responsive to control signals from the controller. The discharge control valve is operable to direct gas from the first and second discharge chambers to the first gas flow path or the second gas flow path. At least one suction control valve is coupled to the controller and responsive to control signals from the controller. The suction control valve is operable to direct gas to the first and second suction chambers along the first gas flow path or the second gas flow path.

In another embodiment, the invention provides a dual-piston linear compressor switchable between an economizer cycle and a single stage cycle. The linear compressor includes a housing divided into a first chamber and a second chamber, a first piston disposed in the first chamber, and a second piston disposed in the second chamber wherein the first and second pistons are opposed and each piston moves back and forth within the respective chamber in opposite directions of movement. The first chamber includes a first input to receive refrigerant into the first chamber and a first output to discharge refrigerant from the first chamber. The second chamber includes a second input to receive refrigerant into the second chamber and a second output to discharge refrigerant from the second chamber. In the economizer cycle, the first input receives refrigerant from an evaporator line, the first output discharges refrigerant to an economizer line, the second input receives refrigerant from the economizer line, and the second output discharges refrigerant to a condenser line. In the single stage cycle, the first and second inputs receive refrigerant from the evaporator line and the first and second outputs discharge refrigerant to the condenser line. The linear compressor further includes a controller operable to switch between the economizer cycle and the single stage cycle.

In another embodiment, the invention provides a refrigeration system including a dual-piston linear compressor including a first piston disposed in a first cylinder and a second piston opposed to the first piston and disposed in a second cylinder. The first cylinder defines in part a first suction chamber and a first discharge chamber, and the second cylinder defines in part a second suction chamber and a second discharge chamber. The refrigeration system includes at least two refrigerant flow paths through the linear compressor wherein the at least two refrigerant flow paths deliver refrigerant from the linear compressor to a condenser and deliver refrigerant to the linear compressor from at least one evaporator. The refrigeration system also includes a controller operable to select one of the at least two refrigerant flow paths through the linear compressor. At least one discharge control valve is coupled to the controller and responsive to control signals from the controller. The discharge control valve is operable to direct refrigerant from the first and second discharge chambers to either of the at least two refrigerant flow paths. At least one suction control valve is coupled to the controller and responsive to control signals from the controller. The suction control valve is operable to direct refrigerant from either of the at least two refrigerant flow paths to the first and second suction chambers.

In yet another embodiment, the invention provides a dual-piston linear compressor operable in an economizer cycle. The linear compressor includes a housing divided into a first chamber and a second chamber, a first piston disposed in the first chamber, and a second piston disposed in the second chamber wherein the first and second pistons are opposed and each piston moves back and forth within the respective chamber in opposite directions of movement. The first chamber includes a first input to receive refrigerant into the first chamber and a first output to discharge refrigerant from the first chamber. The second chamber includes a second input to receive refrigerant into the second chamber and a second output to discharge refrigerant from the second chamber. The first input receives refrigerant from an evaporator line, the first output discharges refrigerant to the second input, the second input receives refrigerant from the first output and an economizer line, and the second output discharges refrigerant to a condenser line.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

DETAILED DESCRIPTION

Figure 1:
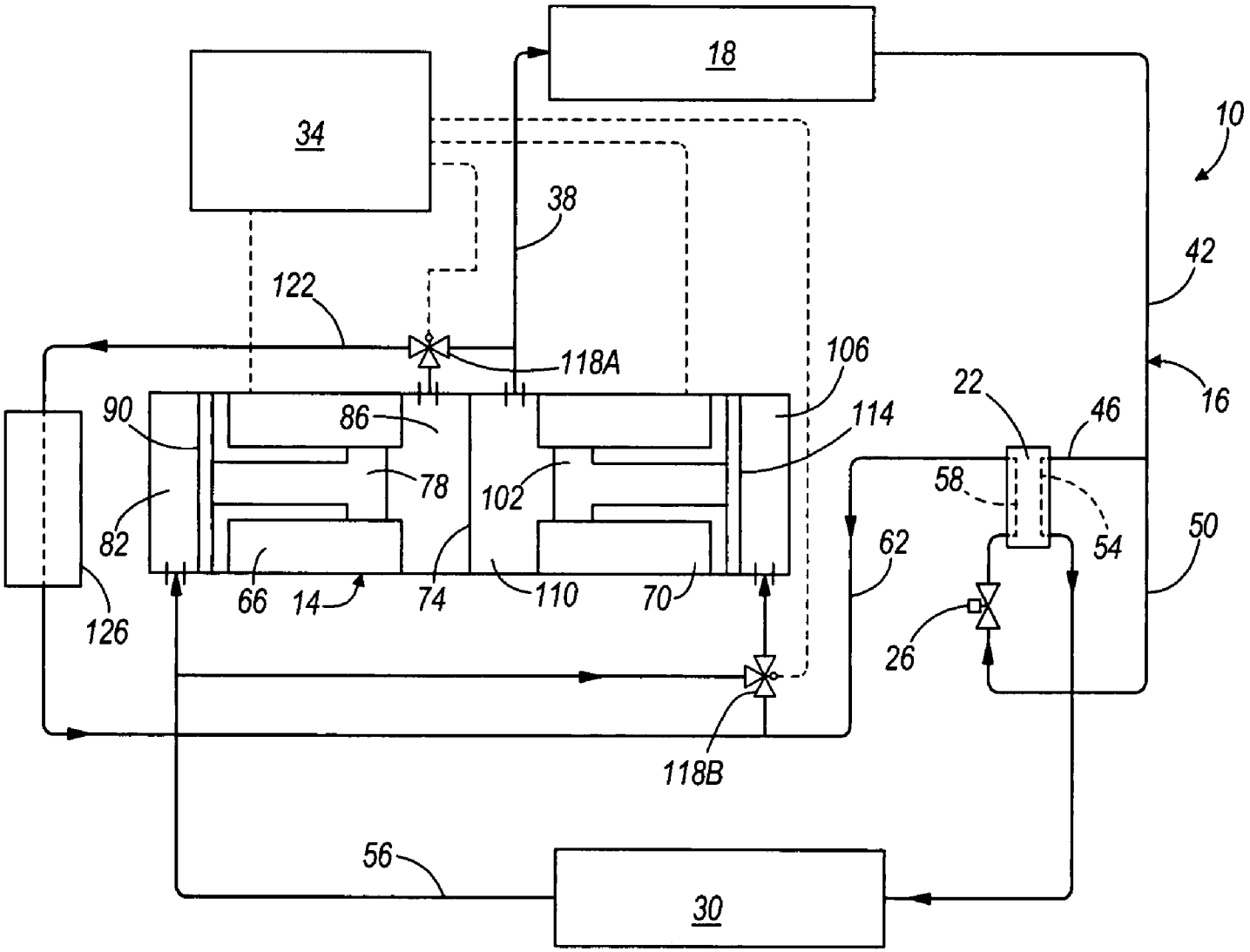
FIG. 1 is a schematic diagram of a refrigeration system including a two-stage linear compressor with dual-opposed pistons embodying the present invention.
Figure 2:
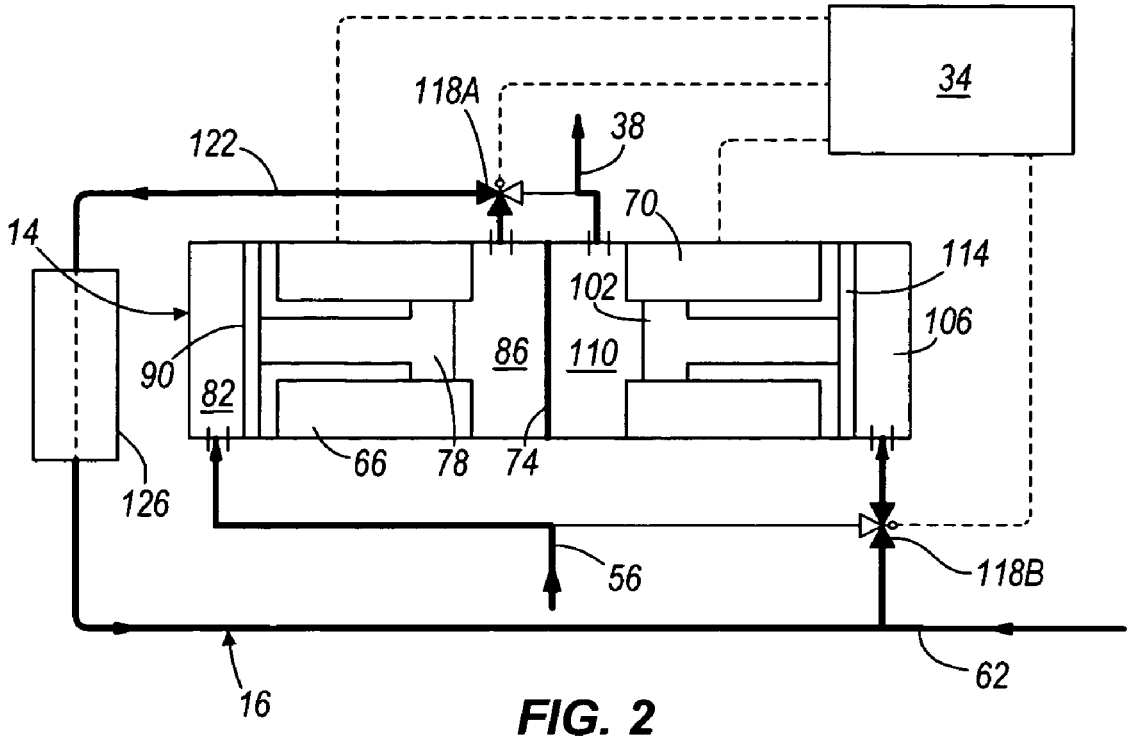
FIG. 2 is a schematic diagram of the two-stage linear compressor shown in FIG. 1 operating in an economizer cycle.

FIG. 1 is a schematic diagram of a refrigeration system 10 including a two-stage linear compressor 14 with dual-opposed pistons. In FIG. 2, the linear compressor 14 is shown in an economizer cycle in which refrigerant flows through the refrigeration system along an economizer gas flow path 16 (shown as a bold line in FIG. 2). In the illustrated embodiment, components of the refrigeration system 10 include the linear compressor 14, a condenser 18, an economizer 22 (also referred to as a liquid subcooler), an expansion device 26 (typically referred to as the expansion valve), and an evaporator 30 (or a group of evaporators), all of which are in fluid communication. In a further embodiment, the refrigeration system 10 includes other components, such as a receiver, a filter dryer, etc. The refrigeration system 10 includes a controller 34 for controlling operation of the linear compressor 14 and operable to switch the linear compressor 14 between the economizer cycle (shown in FIG. 2) and a single stage cycle (shown in FIG. 3). In an alternative embodiment, one controller operates the linear compressor and another controller operates to switch the linear compressor 14 between the economizer cycle and the single stage cycle.

In general, compressed refrigerant discharged from the linear compressor 14 travels to the condenser 18 through a condenser line 38. After leaving the condenser 18, the refrigerant next travels to the economizer 22 located upstream of the evaporator 30 through a refrigerant line 42 that divides into a first line 46 and a second line 50. Refrigerant directed to the first line 46 passes through a first side 54 of the economizer 22 by way of a heat exchanger element (not shown) to the evaporator 30. After the refrigerant passes through the evaporator 30, the refrigerant is delivered to the linear compressor 14 through an evaporator line 56.

When the linear compressor 14 is in the economizer cycle, a portion of the refrigerant is diverted to travel through the second line 50. The second line 50 is fluidly connected to the expansion valve 26. Refrigerant directed to the second line 50 passes through the expansion valve 26, through a second side 58 of the economizer 22, and out to an economizer line 62. Refrigerant that passes through the second side 58 of the economizer 22 is used to cool refrigerant that passes through the first side 54 of the economizer 22. The economizer line 62 delivers refrigerant to the linear compressor 14. In another embodiment, the refrigerant line 42 divides into a first line and a second line after the refrigerant exits the first side 54 of the economizer 22. The first line directs refrigerant to the evaporator 30 and the second line directs refrigerant through the expansion valve 26 and to the second side 58 of the economizer 22.

Figure 3:
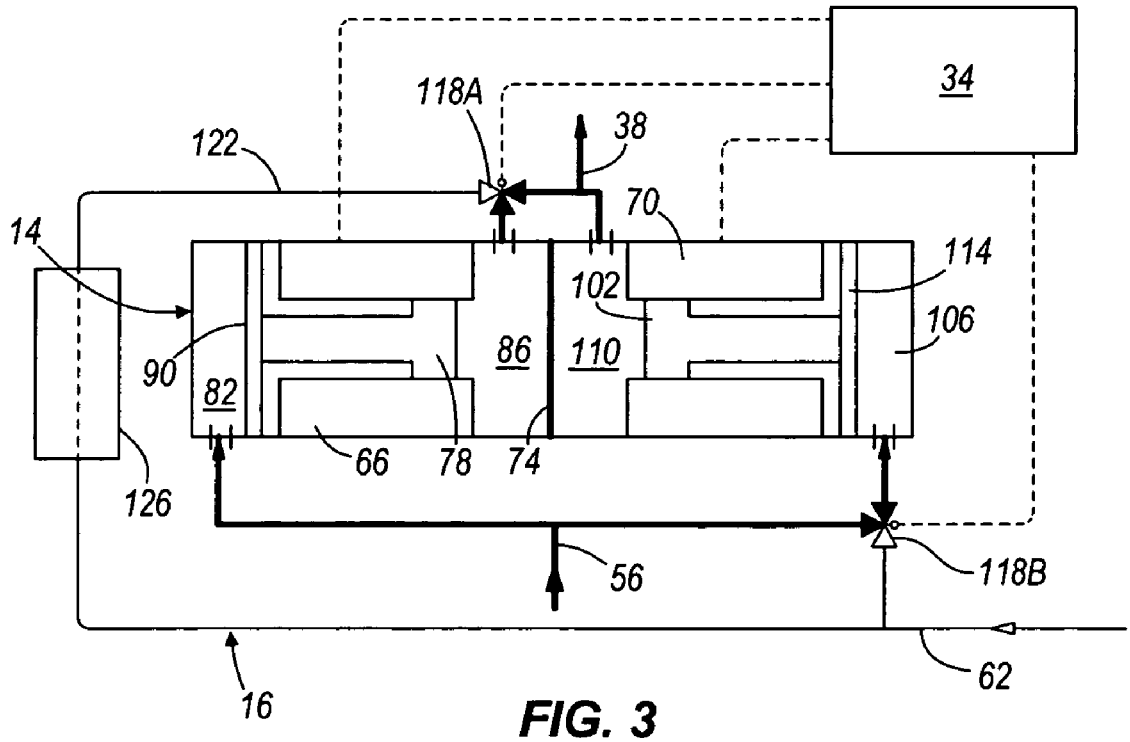
FIG. 3 is a schematic diagram of the two-stage linear compressor shown in FIG. 1 operating in a single stage cycle.

A schematic of the dual-opposed piston linear compressor 14 is shown in FIGS. 1–3. The linear compressor 14 includes a first cylinder 66 and a second cylinder 70 separated by a dividing wall 74. A primary piston 78 is disposed in the first cylinder 66 and divides the first cylinder 66 into a suction chamber 82 and a discharge chamber 86. The primary piston 78 is secured to a spring 90. Refrigerant enters the suction chamber 82 of the first cylinder 66 from a refrigerant flow path and is discharged from the discharge chamber 86 of the first cylinder 66 to a refrigerant flow path (e.g, the economizer gas flow path 16 shown in FIG. 2 or a single stage gas flow path 98 shown in FIG. 3).

A secondary, or economizer, piston 102 is disposed in the second cylinder 70 and divides the second cylinder 70 into a suction chamber 106 and a discharge chamber 110. The secondary piston 102 is secured to a spring 114. The primary and secondary pistons 78, 102 are opposed and each piston moves back and forth in its respective cylinder in opposite directions of movement. Refrigerant enters the suction chamber 106 of the second cylinder 70 from a refrigerant flow path and is discharged from the discharge chamber 110 of the second cylinder 70 to a refrigerant flow path (e.g, the economizer gas flow path 16 shown in FIG. 2 or the single stage gas flow path 98 shown in FIG. 3). In the illustrated embodiment, the controller 34 controls piston stroke of the primary and secondary pistons 78, 102 within the first and second cylinders 66, 70. A linear motor (shown in FIG. 4) for each piston is coupled to the controller 34 and responsive to control signals from the controller 34.

The controller 34 switches the linear compressor 14 between economizer operation (FIG. 2) and single stage operation (FIG. 3) by actuating appropriate control valves 118A and 118B. The control valve 118A is positioned in the refrigerant line between the condenser line 38 and a discharge line 122 proximate the linear compressor 14. The control valve 118A includes three ports, one port communicating with the condenser line 38 and two ports communicating with the discharge line 122. The control valve 118B is positioned in the refrigerant line between the evaporator line 56 and the economizer line 62. The control valve 118B includes three ports, one port communicating with the refrigerant line to the secondary piston suction chamber 106, one port communicating with the evaporator line 56, and one port communicating with the economizer line 62. In the illustrated embodiment, two, three-way valves are shown, however, in further embodiments fewer or more valves and valves of different configurations may be used to direct refrigerant along one of the at least two refrigerant flow paths For example, four two-way valves or a dual switching valve may be used.

In the single stage cycle, refrigerant flows along the single stage gas flow path 98, shown by the bold line in FIG. 3. The linear compressor compresses refrigerant in a single step, whereby the refrigerant is compressed by the primary and secondary pistons 78, 102, with gas flow in parallel. The control valves 118A and 118B are actuated to direct refrigerant along the single stage gas flow path 98. The control valve 118A is actuated to a first position (shown in FIG. 3) to permit refrigerant to flow from the primary piston discharge chamber 86 to the condenser line 38 and the control valve 118B is actuated to a first position (shown in FIG. 3) to permit refrigerant to flow from the evaporator line 56 to the secondary piston suction chamber 106.

In the single stage cycle, the suction chambers 82, 106 for the primary and secondary pistons 78, 102 receive refrigerant through the evaporator line 56 and the pistons 78, 102 compress the refrigerant, which increases the temperature and pressure of the refrigerant. The compressed refrigerant is discharged from the discharge chambers 86, 110 for the primary and secondary pistons 78, 102 as a high-temperature, high-pressure heated gas to the condenser line 38. The refrigerant travels to the condenser 18 and the condenser 18 changes the refrigerant from a high-temperature gas to a warm-temperature liquid. Air and/or liquid, such as water, are generally used to cause this transformation in the condenser 18.

The high-pressure liquid refrigerant then travels to the economizer 22 through the first line 46. In the single stage cycle, the control valve 118B is actuated to the first position to prevent refrigerant from traveling through the second line 50, and thereby the economizer line 62. Therefore, the entire refrigerant from the condenser 18 is directed to the first line 46, through the economizer 22 and to the evaporator 30. In other arrangements the refrigeration system 10 can also include a receiver positioned prior to the economizer 22 for storing refrigerant before the refrigerant is provided to the economizer 22.

When the linear compressor 14 is operating as a single-stage compressor (shown in FIG. 3), the warm-temperature, high-pressure liquid refrigerant passes through the heat exchanger (not shown) on the first side 54 of the economizer 22, which generally does not change the state of the refrigerant. The warm refrigerant then enters the evaporator 30, which cools environmental spaces storing a commodity (not shown). In some embodiments, a second expansion device can be positioned between the economizer 22 and the evaporator 30 for controlling or metering the proper amount of refrigerant into the evaporator 30. In some constructions, air (e.g., a fan) and/or a liquid can be used with the evaporator 30 to promote the cooling action of the environmental spaces. After leaving the evaporator 30, the cool refrigerant re-enters the suction chambers 82, 106 of the linear compressor 14 to be pressurized again and the cycle repeats.

In the economizer cycle, refrigerant flows along the economizer gas flow path 16, shown by the bold line in FIG. 2. The linear compressor 14 compresses refrigerant in a two step process, whereby the refrigerant is compressed first by the primary piston 78 and subsequently by the secondary piston 102. The control valves 118A and 118B are actuated to direct refrigerant along the economizer gas flow path 16. The control valve 118A is actuated to a second position (shown in FIG. 2) to permit refrigerant to flow from the primary piston discharge chamber 86 to the discharge line 122 and the control valve 118B is actuated to a second position (shown in FIG. 2) to permit refrigerant to flow from the economizer line 62 to the secondary piston suction chamber 106.

The suction chamber 82 for the primary piston 78 receives refrigerant from the evaporator line 56, and the discharge chamber 86 for the primary piston 78 discharges refrigerant to the discharge line 122 that feeds the economizer line 62. The suction chamber 106 for the secondary piston 102 receives refrigerant from the economizer line 62, which includes refrigerant from both the primary piston chamber 86 and the economizer 22, and the discharge chamber 110 for the secondary piston 102 discharges refrigerant to the condenser line 38.

In the illustrated embodiment, after being discharged from the primary piston discharge chamber 86, the refrigerant passes through an air-cooled de-superheater 126. The de-superheater 126 cools the refrigerant before it is mixed with refrigerant from the economizer line 62. Therefore, the mixed refrigerant entering the secondary piston suction chamber 106 will be cooler, which reduces the work required for the second stage compression by the secondary piston 102. In further embodiments, the de-superheater uses natural convection or water to cool the refrigerant, or no de-superheater is used.

In the economizer cycle, the suction chamber 82 for the primary piston 78 receives cool refrigerant through the evaporator line 56 and the primary piston 78 compresses the refrigerant, which increases the temperature and pressure of the refrigerant. The compressed refrigerant is discharged from the discharge chamber 86 for the primary piston 78 as a warm-temperature, medium-pressure heated gas to the discharge line 122. Low-temperature, medium-pressure refrigerant gas from the economizer 22 is mixed with the discharged gas from the primary piston chamber 86 in the economizer line 62. The mixed refrigerant enters the suction chamber 106 of the secondary piston 102 from the economizer line 62. Mixing the refrigerant from the primary piston chamber 86 with the refrigerant from the economizer 22 lowers the temperature of the refrigerant entering the secondary piston suction chamber 106, which prevents overheating of the linear compressor. The secondary piston 102 compresses the mixed refrigerant, which increases the temperature and pressure of the refrigerant. The compressed refrigerant is discharged from the discharge chamber 110 of the secondary piston 102 as a high-temperature, high-pressure heated gas to the condenser line 38.

The refrigerant travels to the condenser 18 and the condenser 18 changes the refrigerant from a high-temperature gas to a warm-temperature liquid. The high-pressure liquid refrigerant then travels to the economizer 22 through the refrigerant line 42. In the economizer cycle, the control valve 118B is actuated to the second position to divert refrigerant from the refrigerant line 42 to the second line 50. A portion of the refrigerant is directed to the first line 46 through the first side 54 of the economizer 22 and the remaining refrigerant is directed to the second line 50 through the second side 58 of the economizer 22.

The warm-temperature, high-pressure liquid refrigerant that passes through the heat exchanger (not shown) on the first side 54 of the economizer 22 and is cooled further to a cool-temperature liquid refrigerant. Warm-temperature, high-pressure gas/liquid refrigerant from the second line 50 passes through the expansion valve 26, which creates a pressure drop between the two refrigerant lines 46, 50. Low-temperature, medium-pressure refrigerant exits the expansion valve 26 and passes through the second side 58 of the economizer 22, which cools the refrigerant passing through the first side 54 of the economizer 22.

In the illustrated embodiment, the expansion valve 26 is a thermal expansion valve controlled by temperature and pressure at the outlet of the second side 58 of the economizer 22, i.e., the refrigerant temperature and pressure in the economizer line 62. In a further embodiment, the expansion valve 26 is an electronic valve controlled by the controller 34 based upon measured interstage and/or discharge temperature.

The refrigerant from the first side 54 of the economizer 22 enters the evaporator 30 and cools commodities stored in the environmental spaces (not shown). After leaving the evaporator 30, the cool refrigerant re-enters the suction chamber 82 of the primary piston 78 to be pressurized again and the cycle repeats. The refrigerant from the second side 58 of the economizer 22 enters the economizer line 62 to be mixed with the gas discharged from the discharge chamber 86 of the primary piston 78. The mixed refrigerant enters the suction chamber 106 for the secondary piston 102 from the economizer line 62 to be pressurized again.

To determine whether to operate the linear compressor 14 in the economizer cycle, the controller 34 calculates an overall compression ratio of the linear compressor 14, i.e., the pressure ratio between the condensing pressure and the main cooling load's evaporating pressure. When an overall compression ratio is greater than a pre-determined value, the linear compressor 14 operates in the economizer cycle. For example, in one embodiment the pre-determined value for the overall compression ratio is between about 2:1 and about 10:1, and is preferably about 5:1.

If the linear compressor 14 is operating in the single stage cycle, the controller 34 switches operation of the linear compressor 14 to the economizer cycle by actuating the control valves 118A and 118B to the first position to direct refrigerant along the single stage gas flow path 98. When the overall compression ratio falls below the pre-determined value, the controller 34 switches operation of the linear compressor 14 to the single stage cycle by actuating the control valves 118A and 118B to the second position to direct refrigerant along the economizer gas flow path 16. In one embodiment, the pre-determined value is within a "dead band" where the linear compressor 14 operates in either the economizer cycle or the single stage cycle. Within the "dead band" the control point for switching cycles depends on whether the overall compression ratio is increasing (i.e., switch to the economizer cycle) or decreasing (i.e, switch to the single stage cycle). In another embodiment, the overall compression ratio is calculated based upon secondary discharge pressure and primary suction pressure, however, in further embodiments, other measurements from the refrigeration system 10 are used to determine whether operation in the economizer cycle is necessary.

An economizer cycle is typically more effective at relatively high compression ratios, such as the compression ratios found in low temperature refrigeration, i.e., below 0° F. evaporating. Generally, at higher evaporating temperatures, single stage compression without the economizer cycle is used. An economizer cycle provides more efficient operation of the refrigeration system and cooling of the evaporator. In the economizer cycle, the compression process is split into two stages. The combined compression ratio of the primary and secondary pistons is substantially equal to the compression ratio in the single stage cycle. However, in the economizer cycle compression is a two step process. Because individual compression of the pistons remains relatively low, there is less wear on the pistons and less leakage occurs.

In a further embodiment of the linear compressor, the primary piston 78 has a larger displacement than the secondary piston 102 to increase the compression ratio of the first stage of the linear compressor 14 (i.e., by the primary piston 78) and increase the density of the refrigerant discharged from the first stage of the linear compressor 14 (i.e., from the discharge chamber 86). For example, the primary piston 78 has a larger diameter than the secondary piston 102 or the primary piston 78 has a longer piston stroke than the secondary piston 102. In one embodiment, piston stroke of the primary and secondary pistons 78, 102 is controlled by the controller 34.

Figure 4:
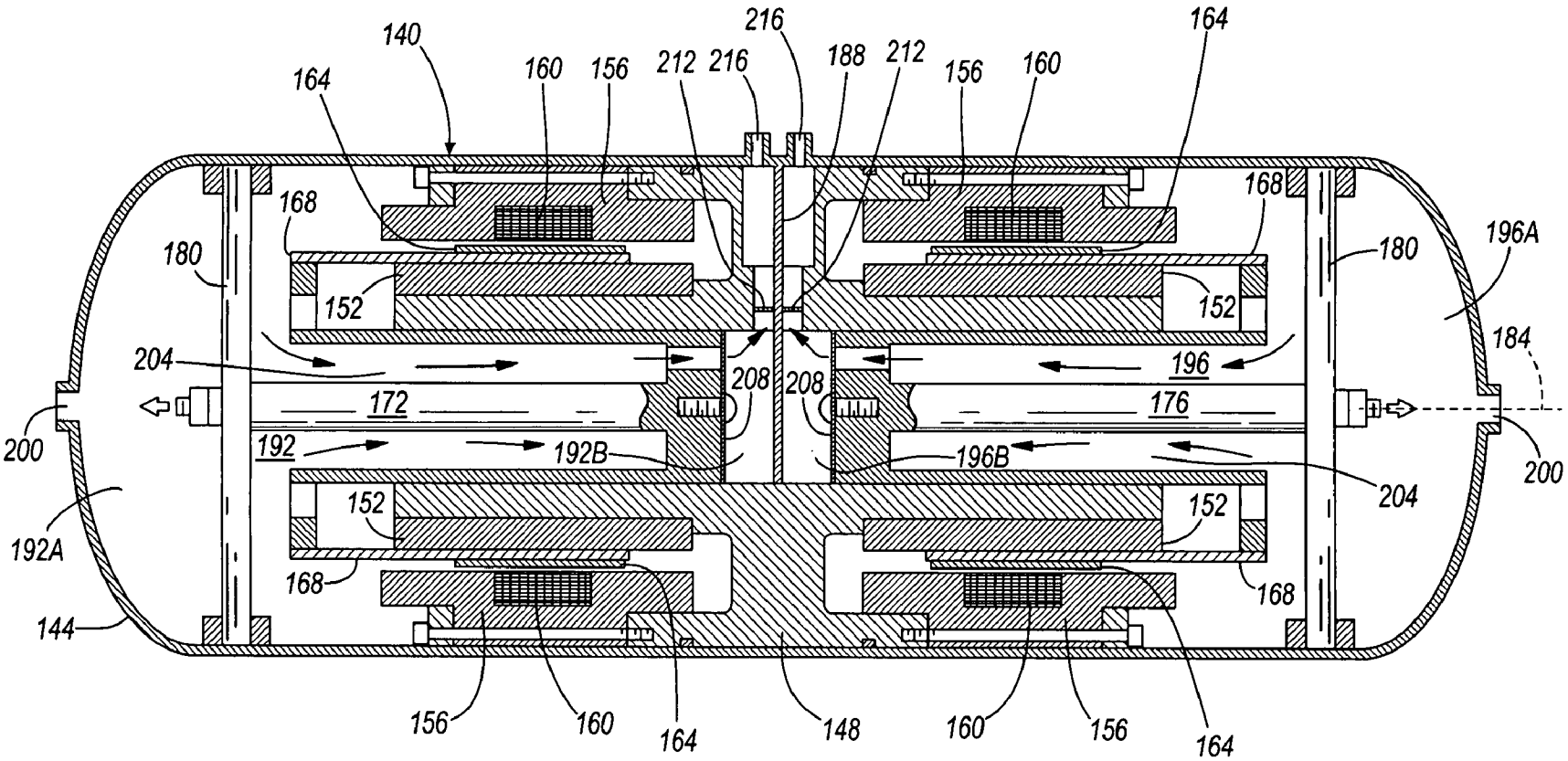
FIG. 4 is a sectional view of a dual opposing, free-piston linear compressor used in the refrigeration system of FIG. 1.

One embodiment of a dual-opposed piston linear compressor 140 is shown in FIG. 4 at an intake stroke. The dual-opposed piston linear compressor 140 includes a housing 144 supporting a main body block 148. Inner and outer laminations 152 and 156 are secured to the main body block 148 and coils 160 are wound on the outer laminations 156, thereby resulting in stators. The stators, when energized, interact with magnet rings 164 mounted on outer cylinders 168. The outer cylinders 168 are fastened to a first piston 172 and a second piston 176, which are secured to springs 180. The interaction between the magnet rings 164 and the energized stators results in the outer cylinders 168 moving the pistons 172, 176 linearly along an axis of reciprocation 184.

A dividing wall 188 separates the first piston 172 and the second piston 176 into a first chamber 192 and a second chamber 196, respectively. Each chamber includes a suction portion 192A and 196A and a compression portion 192B and 196B, or discharge portion. When the first and second pistons 172, 176 are at the intake stroke, refrigerant is allowed to flow from a suction port 200 at the suction portion 192A, 196A of each chamber 192, 196 through channels 204 to the compression chambers 192B, 196B. When moving from the intake stroke to a compression stroke, the channels 204 are closed by suction valves 208 and refrigerant is compressed out of the compression chambers 192B, 196B through discharge valves 212 and discharge ports 216.

The linear motor allows for variable stroke by the pistons, and therefore, the linear compressor provides variable capacity control. In other words, the linear motors can cause the pistons to move a small stroke for a first volume, or to move a larger stroke for a second, larger volume.

Figure 5:
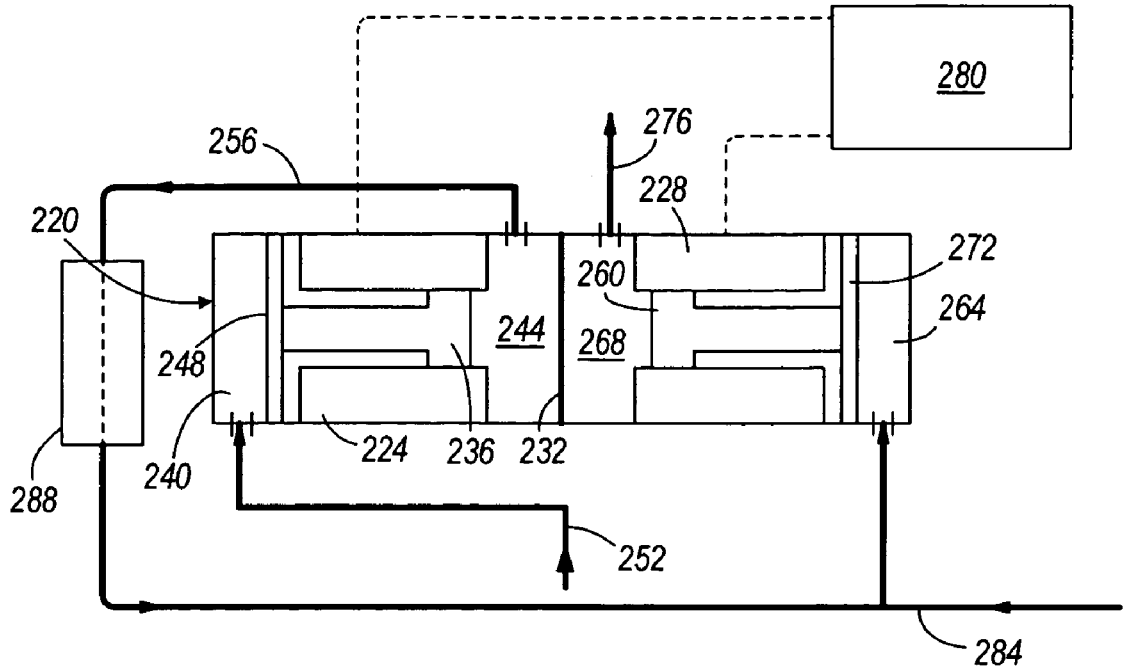
FIG. 5 is a schematic diagram of a two-stage linear compressor operable in an economizer cycle.

FIG. 5 illustrates a two-stage linear compressor 220 that operates in an economizer cycle, but is not switchable to a single stage cycle. The linear compressor 220 may be used in the refrigeration system 10 discussed above with respect to FIG. 1. The linear compressor 220 includes a first cylinder 224 and a second cylinder 228 separated by a dividing wall 232. A primary piston 236 is disposed in the first cylinder 224 and divides the first cylinder 224 into a suction chamber 240 and a discharge chamber 244. The primary piston 236 is secured to a spring 248. Refrigerant enters the suction chamber 240 of the first cylinder 224 from an evaporator line 252 and is discharged from the discharge chamber 244 of the first cylinder 224 to a discharge line 256. The evaporator line 252 delivers refrigerant from an evaporator (not shown) to the suction chamber 240 of the first cylinder 224.

A secondary, or economizer, piston 260 is disposed in the second cylinder 228 and divides the second cylinder 228 into a suction chamber 264 and a discharge chamber 268. The secondary piston 260 is secured to a spring 272. The primary and secondary pistons 236, 260 are opposed and each piston moves back and forth in its respective cylinder in opposite directions of movement. Refrigerant enters the suction chamber 264 of the second cylinder 228 from the discharge line 256 and is discharged from the discharge chamber 268 of the second cylinder 228 to a condenser line 276 that delivers the refrigerant to a condenser (not shown). In the illustrated embodiment, a controller 280 controls piston stroke of the primary and secondary pistons 236, 260 within the first and second cylinders 224, 228. A linear motor (shown in FIG. 4) for each piston is coupled to the controller 280 and responsive to control signals from the controller 280.

The linear compressor 220 illustrated in FIG. 5 operates in the economizer cycle and compresses refrigerant in a two step process, whereby the refrigerant is compressed first by the primary piston 236 and subsequently by the secondary piston 260. The suction chamber 240 for the primary piston 236 receives refrigerant from the evaporator line 252, and the discharge chamber 244 for the primary piston 236 discharges refrigerant to the discharge line 256 that feeds an economizer line 284. The refrigerant passes through a de-superheater 288 to cool the refrigerant before it is mixed with refrigerant from the economizer line 284. The suction chamber 264 for the secondary piston 260 receives refrigerant from the economizer line 284, which includes refrigerant from both the primary piston chamber 244 and an economizer (not shown). The discharge chamber 268 for the secondary piston 260 discharges refrigerant to the condenser line 276.

Various features and advantages of the invention are set forth in the following claims.

What is claimed is:

1. A refrigeration system comprising:

a dual-piston linear compressor including a first piston disposed in a first cylinder and a second piston opposed to the first piston and disposed in a second cylinder, the first piston divides the first cylinder into a first suction chamber and a first discharge chamber and the second piston divides the second cylinder into a second suction chamber and a second discharge chamber;

a first gas flow path through the linear compressor;

a second gas flow path through the linear compressor;

a controller operable to switch the linear compressor between an economizer cycle and a single stage cycle wherein in the economizer cycle flow of gas is along the first gas flow path and in the single stage cycle flow of gas is along the second gas flow path;

at least one discharge control valve coupled to the controller and responsive to control signals from the controller, the discharge control valve operable to direct gas from the first and second discharge chambers to the first gas flow path or the second gas flow path; and at least one suction control valve coupled to the controller and responsive to control signals from the controller, the suction control valve operable to direct gas to the first and second suction chambers along the first gas flow path or the second gas flow path.

2. The refrigeration system of claim 1 wherein in the economizer cycle the first suction chamber receives gas from an evaporator line, the first discharge chamber discharges gas to an economizer line, the second suction chamber receives gas from the economizer line, and the second discharge chamber discharges gas to a condenser line.

3. The refrigeration system of claim 2, and further comprising a de-superheater positioned in the economizer line proximate to the first discharge chamber wherein gas discharged from the first discharge chamber passes through the de-superheater prior to entering the second suction chamber.

4. The refrigeration system of claim 1 wherein in the single stage cycle the first and second suction chambers receive gas from an evaporator line and the first and second discharge chambers discharge gas to a condenser line.

5. The refrigeration system of claim 1 wherein the at least one discharge control valve comprises a three-way valve.

6. The refrigeration system of claim 1 wherein the at least one suction control valve comprises a three-way valve.

7. The refrigeration system of claim 1 wherein the first piston has a larger displacement than the second piston.

8. The refrigeration system of claim 1 wherein the linear compressor operates in the economizer cycle when an overall compression ratio is greater than a pre-determined value.

9. A dual-piston linear compressor switchable between an economizer cycle and a single stage cycle, the linear compressor comprising:

a housing divided into a first chamber and a second chamber;

a first piston disposed in the first chamber;

a second piston disposed in the second chamber wherein the first and second pistons are opposed and each piston moves back and forth within the respective chamber in opposite directions of movement;

a first input to receive refrigerant into the first chamber and a first output to discharge refrigerant from the first chamber;

a second input to receive refrigerant into the second chamber and a second output to discharge refrigerant from the second chamber, wherein in the economizer cycle the first input receives refrigerant from an evaporator line, the first output discharges refrigerant to an economizer line, the second input receives refrigerant from the economizer line, and the second output discharges refrigerant to a condenser line, and further wherein in the single stage cycle, the first and second inputs receive refrigerant from the evaporator line, and the first and second outputs discharge refrigerant to the condenser line; and a controller operable to switch between the economizer cycle and the single stage cycle.

10. The linear compressor of claim 9 wherein the first piston has a larger displacement than the second piston.

11. The linear compressor of claim 9, and further comprising at least one control valve coupled to the controller and responsive to control signals from the controller, the at least one control valve operable to direct flow of refrigerant from the first output.

12. The linear compressor of claim 11 wherein the at least one control valve comprises a control valve positioned between the condenser line and the economizer line.

13. The linear compressor of claim 12 wherein in the single stage cycle the control valve is actuated to a first position to permit refrigerant to flow from the first output to the condenser line, and in economizer cycle the control valve is actuated to a second position to permit refrigerant to flow from the first output to the economizer line.

14. The linear compressor of claim 9, and further comprising at least one control valve coupled to the controller and responsive to control signals from the controller, the at least one control valve operable to direct flow of refrigerant to the second input.

15. The linear compressor of claim 14 wherein the at least one control valve comprises a control valve positioned between the evaporator line and the economizer line.

16. The linear compressor of claim 15 wherein in the single stage cycle the control valve is actuated to a first position to permit refrigerant to flow from the evaporator line to the second input, and in the economizer cycle the control valve is actuated to a second position to permit refrigerant to flow from the economizer line to the second input.

17. The linear compressor of claim 9 wherein the linear compressor operates in the economizer cycle when an overall compression ratio is greater than a pre-determined value.

18. A refrigeration system comprising:

a dual-piston linear compressor including a first piston disposed in a first cylinder and a second piston opposed to the first piston and disposed in a second cylinder, the first cylinder defining in part a first suction chamber and a first discharge chamber and the second cylinder defining in part a second suction chamber and a second discharge chamber;

at least two refrigerant flow paths through the linear compressor wherein the at least two refrigerant flow paths deliver refrigerant from the linear compressor to a condenser and deliver refrigerant to the linear compressor from at least an evaporator;

a controller operable to select one of the at least two refrigerant flow paths through the linear compressor;

at least one discharge control valve coupled to the controller and responsive to control signals from the controller, the discharge control valve operable to direct refrigerant from the first and second discharge chambers to either of the at least two refrigerant flow paths; and at least one suction control valve coupled to the controller and responsive to control signals from the controller, the suction control valve operable to direct refrigerant from either of the at least two refrigerant flow paths to the first and second suction chambers.

19. The refrigeration system of claim 18, and further comprising:

a condenser in fluid communication with the linear compressor by a condenser line;

an economizer in fluid communication with the condenser and selectively fluidly communicating with the linear compressor by an economizer line; and an evaporator in fluid communication with the economizer and in fluid communication with the linear compressor by an evaporator line.

20. The refrigeration system of claim 19 wherein in the economizer cycle, the first suction chamber receives gas from the evaporator line, the first discharge chamber discharges gas to the second suction chamber, the second suction chamber receives gas from the first discharge chamber and the economizer line, and the second discharge chamber discharges gas to the condenser line.

21. The refrigeration system of claim 19 wherein in the single stage cycle the first and second suction chambers receive gas from the evaporator line and the first and second discharge chambers discharge gas to the condenser line.

22. The refrigeration system of claim 18 wherein the controller is operable to switch the linear compressor between an economizer cycle and a single stage cycle, and further wherein a first of the least two refrigerant flow paths is selected in the economizer cycle and a second of the at least two refrigerant flow paths is selected in the second stage cycle.

23. The refrigeration system of claim 18 wherein the at least one discharge control valve comprises a three-way valve.

24. The refrigeration system of claim 23 wherein the discharge control valve is positioned between the condenser line and the economizer line, and the discharge control valve is operable to permit refrigerant to flow from the first discharge chamber to the condenser line or to permit refrigerant to flow from the economizer line.

25. The refrigeration system of claim 18 wherein the at least one suction control valve comprises a three-way valve.

26. The refrigeration system of claim 25 wherein the suction control valve is positioned between the evaporator line and the economizer line, and the suction control valve is operable to permit refrigerant to flow from the evaporator line to the second suction chamber and to permit refrigerant to flow from the economizer line to the second suction chamber.

27. The refrigeration system of claim 18 wherein the linear compressor operates in the economizer cycle when an overall compression ratio is greater than a predetermined value.

28. A dual-piston linear compressor operable in an economizer cycle, the linear compressor comprising:

a housing divided into a first chamber and a second chamber;

a first piston disposed in the first chamber;

a second piston disposed in the second chamber wherein the first and second pistons are opposed and each piston moves back and forth within the respective chamber in opposite directions of movement;

a first input to receive refrigerant into the first chamber and a first output to discharge refrigerant from the first chamber; and a second input to receive refrigerant into the second chamber and a second output to discharge refrigerant from the second chamber, wherein the first input receives refrigerant from an evaporator line, the first output discharges refrigerant to the second input, the second input receives refrigerant from the first output and an economizer line, and the second output discharges refrigerant to a condenser line.

29. The linear compressor of claim 28 wherein the first piston has a larger displacement than the second piston.

30. The linear compressor of claim 28 wherein the first output discharges refrigerant to the economizer line and the second input receives refrigerant from the economizer line.

* * * * *